US008104741B2

(12) United States Patent
Weigen

(10) Patent No.: US 8,104,741 B2
(45) Date of Patent: Jan. 31, 2012

(54) WATER BOX TOILET SENSING FLUSHING SYSTEM

(75) Inventor: Chen Weigen, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 106 days.

(21) Appl. No.: 12/303,601

(22) PCT Filed: Jun. 4, 2007

(86) PCT No.: PCT/IB2007/001484

§ 371 (c)(1),
(2), (4) Date: Feb. 20, 2009

(87) PCT Pub. No.: WO2007/141627

PCT Pub. Date: Dec. 13, 2007

(65) Prior Publication Data

US 2010/0044601 A1 Feb. 25, 2010

(30) Foreign Application Priority Data

Jun. 8, 2006 (CN) ..... 2006 2 0042499 U

(51) Int. Cl.
*F16K 31/12* (2006.01)

(52) U.S. Cl. ..... 251/129.04; 251/129.15; 4/406

(58) Field of Classification Search ..... 251/129.04, 251/129.15; 4/405, 406, 623
See application file for complete search history.

(56) References Cited

U.S. PATENT DOCUMENTS

| | | | | |
|---|---|---|---|---|
| 4,392,260 | A * | 7/1983 | Bensen | 4/324 |
| 4,756,031 | A | 7/1988 | Barrett | |
| 6,019,343 | A | 2/2000 | Tsai | |
| 6,752,371 | B2 * | 6/2004 | Herbert et al. | 251/54 |
| 2005/0278842 | A1 | 12/2005 | Yen | |
| 2006/0101566 | A1 | 5/2006 | Parsons et al. | |

FOREIGN PATENT DOCUMENTS

| | | | |
|---|---|---|---|
| CN | 2110042 | U | 7/1992 |
| CN | 1327114 | A | 12/2001 |
| CN | 2587959 | Y | 11/2003 |
| CN | 2589533 | Y | 12/2003 |
| DE | 100 02 308 | A1 | 8/2001 |
| JP | 5017984 | A | 1/1993 |
| JP | 7027240 | A | 1/1995 |

OTHER PUBLICATIONS

International Search Report; PCT/IB2007/001484.
European Patent Office, Extended European Search Report, EP07734766.4, Nov. 29, 2011.

* cited by examiner

*Primary Examiner* — John Fristoe, Jr.
(74) *Attorney, Agent, or Firm* — Foley & Lardner LLP

(57) ABSTRACT

A water-box toilet sensing flushing system including an inlet loop, loop washer, linking pipe, solenoid valve outer bracket, switch diaphragm, solenoid valve, connector, water bowl assembly, outlet washer wire, and sensor. This is an added device to the original manual structure of the water box. It does not affect the original function; but a sensing control water box automatic flushing device is added.

18 Claims, 1 Drawing Sheet

WATER BOX TOILET SENSING FLUSHING SYSTEM

FIELD OF INVENTION

The present invention relates to a water-box toilet sensing flushing system that can be widely applied to water-box flushing toilets.

BACKGROUND OF THE INVENTION

The present water-box flushing toilet basically adopts the manual lever structure to pull the pipe close rubber washer at the outlet to realize flushing.

SUMMARY OF THE INVENTION

The present invention uses the current pressure of running water, and a sensing signal controls the switch of solenoid valve. The piston-style water box pulls the pipe close rubber washer at the outlet to finish flushing process. The whole assembly is attached to the original water box fittings through a fixed connection. The original flushing function and method remain the same. A sensing control automatic flushing function is added.

The purpose of the present invention is to add a sensing control automatic flushing function On the base of the original manual flushing fittings so that the original water-box toilet possesses both manual and automatic flushing functions. On the base of the original water box fittings, a sensing control automatic flushing structure is added. This structure includes 3 parts: an inlet pipe loop device, a solenoid valve control switch, and a water bowl pulling device. An inlet pipe loop device is added to the inlet pipe connection to link the inlet pipe. A linking pipe links the inlet of the solenoid valve and the inlet loop. The sensor detects objects and sends a signal to the solenoid valve, so that the opening and closing of the solenoid valve can supply or stop water to the water bowl. When the valve is closed, the diaphragm of the solenoid valve is shut completely to cut-off the running water. When the valve is opened, the running water pressure is higher than the water pressure in the water box, so the diaphragm turns upward and allows water to flow into the water bowl. The movement of water bowl piston pulls the pipe close rubber washer to realize flushing. The water box piston movement activates the linking wire that connects the water box piston shaft and the pipe close rubber washer so that the flushing process can be completed. The characteristics of this structure are that it keeps the function of the original fittings, it makes use of the running water pressure, and there is no need for an extra dynamic structure.

It is the intention of at least an embodiment of the invention to provide a flushing system comprising: a sensor; a solenoid valve operatively connected to the sensor, to receive signals from the sensor; an inlet loop; a hydraulically operated outlet closure actuator; a fluid conduit providing fluid communication between the outlet closure actuator and the inlet loop; wherein the solenoid valve is assembled as part of the fluid conduit, and the solenoid valve controls the flow of fluid through the fluid conduit; wherein a first signal received by the solenoid valve from the sensor triggers the solenoid valve to open so fluid may flow to the outlet closure actuator.

DESCRIPTION OF THE PREFERRED EMBODIMENTS

Figure 1:
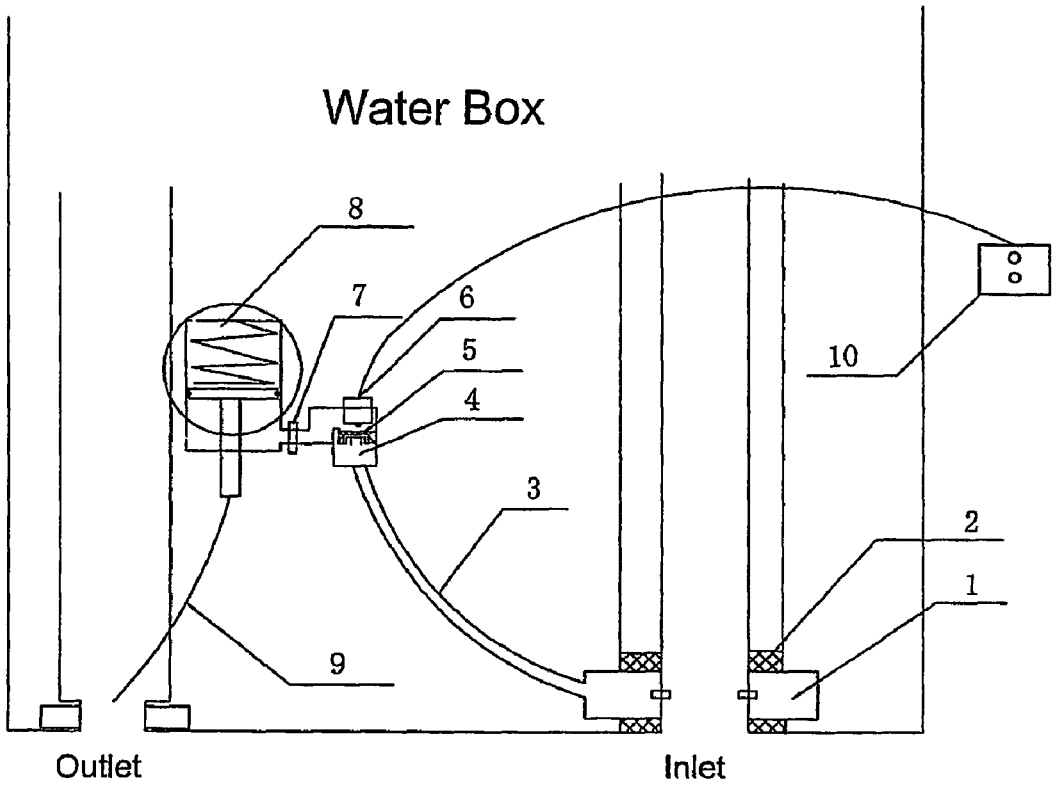
FIG. 1 shows a schematic view of the structure of the present invention.

The enclosed drawing illustrates how the present invention functions. As shown in FIG. 1, the present invention consists of an inlet loop (1), loop washer (2), inlet pipe (3), solenoid valve outer bracket (4), switch diaphragm (5), solenoid valve (6), connector (7), outlet closure actuator (8), outlet washer wire (9), and sensor (10). At the fluid inlet of the original water box fittings, a loop washer (2) and an inlet loop (1) are added. The inlet pipe (3) links the solenoid valve outer bracket (4) and the inlet loop (1) links the fluid inlet running water. The loop washer (2) seals the water box, so that the running water cannot get through. Fittings such as the switch diaphragm (5) and solenoid valve (6) are installed in the solenoid valve outer bracket (4). The solenoid valve (6) is operatively connected to the external sensor (10), which can sense an object and send a signal to the solenoid valve (6) to open or close the valve. When the solenoid valve (6) is opened, the pressure difference above and below the switch diaphragm (5) opens the switch diaphragm (5), so that running water can flow into the outlet closure actuator (8). When the solenoid valve (6) is in closed state, the water flows to the part above the switch diaphragm (5) so that the switch diaphragm (5) is closed to stop water passage. The outlet closure actuator (8), under the pressure of the water supply and cutoff, moves the piston shaft inside upward and downward to pull the outlet washer wire (9), so that the outlet rubber washer in the water box can be pulled. Thus the flushing is realized just as the manual device.

Although the present invention has been shown and described herein by way of a preferred embodiment, it is understood that the invention may be modified without departing form the scope and spirit of the invention as defined in the following claims.

What is claimed is:

1. A flushing system comprising:

a sensor;

a solenoid valve operatively connected to the sensor, to receive signals from the sensor;

an inlet loop configured to be located within a toilet water tank and coupled to a fluid inlet;

a hydraulically operated outlet closure actuator; and a fluid conduit providing fluid communication between the outlet closure actuator and the inlet loop;

wherein the solenoid valve is assembled as part of the fluid conduit, and the solenoid valve controls the flow of fluid through the fluid conduit;

wherein a first signal received by the solenoid valve from the sensor triggers the solenoid valve to open so fluid may flow to the outlet closure actuator;

wherein a second signal received by the solenoid valve triggers the solenoid valve to close so fluid is restricted from flowing to the outlet closure actuator, and wherein fluid may flow to the water tank when the solenoid valve is closed.

2. The flushing system of claim 1, wherein the sensor is a proximity sensor.

3. The flushing system of claim 1, further comprising a timing device operatively connected to the solenoid valve that sends the second signal received by the solenoid valve to close the solenoid valve.

4. The flushing system of claim 1, further comprising an outlet closure operatively connected to the outlet closure actuator.

5. The flushing system of claim 1, wherein the outlet closure actuator comprises a spring-loaded piston and cylinder assembly.

6. The flushing system of claim 1, wherein the outlet closure actuator is configured to be operatively connected to a fluid outlet.

7. A water box toilet comprising:

a water bowl;

a toilet water tank having a fluid inlet and a fluid outlet, the fluid outlet being in fluid communication with the water bowl;

a flushing system comprising:

a sensor configured to detect the presence of a user;

a solenoid valve operatively coupled to the sensor and located within the toilet water tank;

an inlet loop located within the toilet water tank and coupled to a fluid inlet;

a hydraulically operated outlet closure actuator operatively coupled to the fluid outlet; and a fluid conduit located within the toilet water tank and having a first end coupled to the inlet loop and a second end coupled to the outlet closure actuator;

wherein the solenoid valve is assembled as part of the fluid conduit and the solenoid valve controls the flow of fluid through the fluid conduit;

wherein a first signal received by the solenoid valve from the sensor triggers the solenoid valve to open so fluid may flow to the outlet closure actuator.

8. The water box toilet of claim 7, wherein the sensor is a proximity sensor.

9. The water box toilet of claim 7, wherein the flushing system further comprises a timing device operatively coupled to the solenoid valve that sends a second signal received by the solenoid valve to close the solenoid valve so fluid is restricted from flowing to the outlet closure actuator.

10. The water box toilet of claim 7, wherein the flushing system further comprises an outlet closure operatively coupled to the outlet closure actuator.

11. The water box toilet of claim 7, wherein the outlet closure actuator comprises a spring-loaded piston and cylinder assembly.

12. The water box toilet of claim 7, further comprising a manual flushing system having fittings to allow a user to manually flush the water box toilet.

13. A flushing system comprising:

a sensor;

a solenoid valve operatively connected to the sensor to receive signals from the sensor, the solenoid valve being configured to be located within a toilet water tank;

an inlet loop configured to be located within the toilet water tank and coupled to a fluid inlet;

a hydraulically operated outlet closure actuator; and a fluid conduit providing fluid communication between the outlet closure actuator and the inlet loop;

wherein the solenoid valve is assembled as part of the fluid conduit, the solenoid valve controls the flow of fluid through the fluid conduit, and the solenoid valve is configured to be located within the toilet water tank;

wherein a first signal received by the solenoid valve from the sensor triggers the solenoid valve to open so fluid may flow to the outlet closure actuator.

14. The flushing system of claim 13, wherein the sensor is a proximity sensor.

15. The flushing system of claim 13, further comprising a timing device operatively connected to the solenoid valve that sends a second signal received by the solenoid valve to close the solenoid valve so fluid is restricted from flowing to the outlet closure actuator.

16. The flushing system of claim 13, further comprising an outlet closure operatively connected to the outlet closure actuator.

17. The flushing system of claim 13, wherein the outlet closure actuator comprises a spring-loaded piston and cylinder assembly.

18. The flushing system of claim 13, wherein the outlet closure actuator is configured to be operatively connected to a fluid outlet.

* * * * *